US007141626B2

(12) United States Patent
Rodrigues et al.

(10) Patent No.: US 7,141,626 B2
(45) Date of Patent: Nov. 28, 2006

(54) FIBERGLASS NON-WOVEN CATALYST

(75) Inventors: Klein A. Rodrigues, Signal Mountain, TN (US); Allen M. Carrier, Hixson, TN (US); Alvie L. Foster, Chattanooga, TN (US); Bick Hicks, Ooltewah, TN (US); James C. Long, Chattanooga, TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 10/283,430

(22) Filed: Oct. 29, 2002

(65) Prior Publication Data

US 2004/0082726 A1 Apr. 29, 2004

(51) Int. Cl.
*C08F 8/30* (2006.01)

(52) U.S. Cl. ..... 525/328.2; 525/328.8; 525/330.1; 525/344; 525/362; 525/363

(58) Field of Classification Search ..... 525/328.2, 525/344, 262, 363, 330.1, 328.8
See application file for complete search history.

(56) References Cited

U.S. PATENT DOCUMENTS

| | | | | |
|---|---|---|---|---|
| 3,375,227 | A * | 3/1968 | Hicks | 525/131 |
| 3,920,868 | A * | 11/1975 | Hammer et al. | 427/354 |
| 4,756,714 | A * | 7/1988 | Hendrix et al. | 8/115.6 |
| 4,988,763 | A * | 1/1991 | Kessler et al. | 525/61 |
| 5,095,071 | A * | 3/1992 | Chen | 525/163 |
| 5,318,990 | A | 6/1994 | Strauss | 524/549 |
| 5,340,868 | A | 8/1994 | Strauss et al. | 524/461 |
| 5,534,306 | A * | 7/1996 | Rockrath et al. | 427/407.1 |
| 5,661,213 | A | 8/1997 | Arkens et al. | 524/555 |
| 5,763,524 | A | 6/1998 | Arkens et al. | 524/549 |
| 5,840,822 | A | 11/1998 | Lee et al. | 528/44 |
| 5,919,716 | A * | 7/1999 | Raynolds et al. | 442/154 |
| 5,977,232 | A | 11/1999 | Arkens et al. | 524/404 |
| 6,136,916 | A | 10/2000 | Arkens et al. | 524/556 |
| 6,140,388 | A | 10/2000 | Nass et al. | 523/139 |
| 6,331,350 | B1 | 12/2001 | Taylor et al. | 428/221 |
| 6,660,044 | B1 * | 12/2003 | Igarashi et al. | 8/115.51 |

FOREIGN PATENT DOCUMENTS

| | | |
|---|---|---|
| EP | 0 826 710 A2 | 3/1998 |
| EP | 0 826 710 A3 | 1/1999 |
| EP | 0 990 728 A1 | 4/2000 |
| EP | 0 826 710 B1 | 9/2001 |

* cited by examiner

*Primary Examiner*—Bernard Lipman
(74) *Attorney, Agent, or Firm*—David LeCroy

(57) ABSTRACT

The present invention relates to novel catalysts for use with a fiberglass non-woven binder. The catalyst can be a Lewis acid, an organic acid salt, a free-radical generator, or a mixture thereof. The catalyst provides stronger bonding, increased crosslinking density, reduced curing times, and reduced curing temperatures. Fiberglass mats made with polymer binder compositions containing the catalyst exhibit both flexibility and elasticity, allowing the mats to be compressed for storage, yet return to original thickness once the compressive forces are removed. Formaldehyde-free wood composites, such as plywood and fiberboard, may also be produced with polymer binder compositions containing the catalyst.

12 Claims, No Drawings

FIBERGLASS NON-WOVEN CATALYST

FIELD OF THE INVENTION

The invention relates to novel catalysts for use with a fiberglass non-woven binder. The catalyst can be a Lewis acid, an organic acid salt, a free-radical generator, or a mixture thereof. The catalyst provides stronger bonding, increased crosslinking density, reduced curing times, and reduced curing temperatures.

BACKGROUND OF THE INVENTION

Fiberglass insulation products generally consist of glass fibers bonded together by a cross-linked polymeric binder. An aqueous polymer binder is sprayed onto matted glass fibers soon after they have been formed, and while they are still hot. The polymer binder tends to accumulate at the junctions where fibers cross each other, to hold the fibers together at these points. The heat from the fibers causes most of the water in the binder to vaporize.

The polymeric binder has been a phenol-formaldehyde polymer. More recently formaldehyde-free polymer systems have been used to avoid formaldehyde emissions. The formaldehyde-free polymer system consists of 1) a polymer of a polycarboxyl, polyacid, polyacrylic, or anhydride; 2) an active hydrogen compound (hydroxyl or polyol group) such as trihydric alcohol (U.S. Pat. Nos. 5,763,524; 5,318,990), triethanolamine (U.S. Pat. No. 6,331,350; EP 0990728), beta-hydroxy alkyl amides (U.S. Pat. No. 5,340,868; or hydroxy alkyl urea (U.S. Pat. Nos. 5,840,822; 6,140,388); and 3) a catalyst or accelerator such as a phosphorous-containing compound (U.S. Pat. No. 6,136,916) or a fluoroborate compound (U.S. Pat. No. 5,977,232). The catalyst functions to decrease the cure time, to increase the cross-linking density, to reduce the cure time and/or to decrease the water sensitivity of the binder.

One problem with current catalysts is that they produce films that can discolor. Also the films may release phosphorous-containing vapors.

There is a need for a fiberglass binder system having a catalyst other than the phosphorous or fluoroborate catalysts currently used.

Surprisingly it has been found that Lewis acids, Lewis bases, and free-radical generators are effective catalysts for crosslinking polymeric binders for fiberglass non-wovens. The use of these catalysts produces a strong, yet flexible and clear, fiberglass insulation binder system.

SUMMARY OF THE INVENTION

The present invention is directed to a non-woven binder composition containing a polymer binder having an acid functionality, an active hydrogen crosslinker containing hydroxyl, polyol, or amine functionality, and a catalyst that is either a Lewis acid, an organic acid salt, or a free-radical generator.

The invention is also directed to a bonded fiberglass mat in which the mat is bound with a copolymer binder system having a catalyst that is either a Lewis acid, an organic acid salt, or a free-radical generator.

DETAILED DESCRIPTION OF THE INVENTION

The present invention relates to a non-woven binder composition containing a polymeric binder; an active hydrogen crosslinker; and a catalyst or accelerator that is a Lewis acid, a Lewis base, or a free radical generator. The catalyst or accelerator allows the crosslinking reaction between a carboxyl group on the polymer binder and an active hydrogen-containing compound to occur faster, at a lower temperature, and more completely.

In one preferred embodiment, the catalyst is a Lewis acid. Lewis acids useful in the present invention include, but are not limited to, dibutyltindilaurate, iron(III)chloride, scandium(III)trifluoromethanesulfonic acid, boron trifluoride, tin (IV)chloride, $Al_2(SO_4)_3xH_2O$, $MgCl_2.6H_2O$, $AlK(SO_4)_2.10H_2O$, and Lewis acids having the formula $MX_n$ wherein M is a metal, X is a halogen atom or an inorganic radical, and n is an integer of from 1 to 4, such as $BX_3$, $AlX_3$, $FeX_3$, $GaX_3$, $SbX_3$, $SnX_4$, $AsX_5$, $ZnX_2$, and $HgX_2$ More preferably, the Lewis acid catalyst is selected from $Al_2(SO_4)_3xH_2O$, $MgCl_2.6H_2O$, $AlK(SO_4)_2.10H_2O$ . A combination of Lewis acid catalysts may also be used.

In another embodiment, the catalyst is a salt of an organic acid. Examples of organic acids are citric acid, tartaric acid, lactic acid, acetic acid, polyacrylic acid, and the like. The preferred salts of these acids are the alkaline earth salts, preferably the magnesium and calcium salts; titanates; and zirconates. The salts may be formed in situ by adding a base, such as $Mg(OH)_2$.

In another embodiment, the catalyst could be a free-radical generator. By free-radical generator, as used herein is meant that the catalyst will produce free radicals during the curing process. Free radicals are generated by the use of one or more mechanisms such as photochemical initiation, thermal initiation, redox initiation, degradative initiation, ultrasonic initiation, or the like. Preferably the free-radical generators are selected from azo-type compounds, peroxide type compounds, or mixtures thereof. Examples of suitable peroxide compounds include, but are not limited to, diacyl peroxides, peroxy esters, peroxy ketals, di-alkyl peroxides, and hydroperoxides, specifically hydrogen peroxide, benzoyl peroxide, deconoyl peroxide, lauroyl peroxide, succinic acid peroxide, cumere hydroperoxide, t-butylhydroperoxide, t-butyl peroxy acetate, 2,2 di (t-butyl peroxy) butane di-allyl peroxide), cumyl peroxide, or mixtures thereof. Examples of suitable azo-type compounds include, but are not limited to azobisisobutyronitrile (AIBN), 2,2'-azobis (N,N'-dimethyleneisobutyramide) dihydochloride (or VA-044 of Wako Chemical Co.), 2,2'-azobis(2,4-dimethyl valeronitrile) (or V-65 of Wako Chemical Co.), 1,1'-azobis (1-cyclohexane carbonitrile), acid-functional azo-type initiators such as 4,4'-azobis (4-cyanopentanoic acid).

The catalyst is admixed with a polymer binder and an active hydrogen component to form a polymer binder composition. The catalyst is present at from 1 to 25 percent by weight, and preferably from 1 to 10 percent by weight, based on the weight of the polymer.

The polymer binder is synthesized from one or more acid monomers. The acid monomer may be a carboxylic acid monomer, a sulfonic acid monomer, a phosphonic acid monomer, or a mixture thereof. The acid monomer makes up from 1 to 99 mole percent, preferably from 50 to 95 mole percent, and most preferably from 60 to 90 mole percent of the polymer. In one preferred embodiment, the acid monomer is one or more carboxylic acid monomers. The carboxylic acid monomer includes anhydrides that will form carboxyl groups in situ. Examples of carboxylic acid monomers useful in forming the polymer of the invention include, but are not limited to acrylic acid, methacrylic acid, crotonic acid, isocrotonic acid, fumaric acid, maleic acid, cinnanic acid, 2-methylmaleic acid, itaconic acid, 2-methylitaconic acid, sorbic acid, alpha-beta-methyleneglutaric acid, maleic anhydride, itaconic anhydride, acrylic anhydride, methacrylic anhydride. Preferred monomers are acrylic acid and methacrylic acid. The carboxyl groups could also be formed in situ, such as in the case of isopropyl esters of acrylates and methacrylates that will form acids by hydrolysis of the esters when the isopropyl group leaves. Examples of phosphonic acid monomers useful in forming the copolymer include, but are not limited to, vinyl phosphonic acid.

Examples of sulfonic acid monomers useful in forming the copolymer include, but are not limited to styrene sulfonic acid, 2-acrylamido-2-methylpropane sulfonic acid, vinyl sulfonic acid, methallyl sulfonic acid, sulfonated styrene, and allyloxybenzenesulfonic acid.

Other ethylenically unsaturated monomers may also be used to form a copolymer binder, at a level of up to 50 mole percent, and preferably up to 30 mole percent based on the total monomer. These monomers can be used to obtain desirable properties of the copolymer, in ways known in the art. For example, hydrophobic monomers can be used to increase the water-resistance of the nonwoven. Monomers can also be use to adjust the Tg of the copolymer to meet the end-use application requirements. Useful monomers include, but are not limited to, (meth)acrylates, maleates, (meth)acrylamides, vinyl esters, itaconates, styrenics, acrylonitrile, nitrogen functional monomers, vinyl esters, alcohol functional monomers, and unsaturated hydrocarbons. Low levels of up to a few percent of crosslinking monomers may also be used to form the polymer. The extra crosslinking improves the strength of the bonding, yet at higher levels would be detrimental to the flexibility of the resultant non-woven material. The crosslinking moieties can be latent crosslinking where the crosslinking reaction takes place not during polymerization but during curing of the binder. Chain-transfer agents may also be used, as known in the art, in order to regulate chain length and molecular weight. The chain transfer agents may be multifunctional so as to produce star-type polymers.

The polymer is synthesized by known methods of polymerization, including solution, emulsion, suspension and inverse emulsion polymerization methods. In one preferred embodiment, the polymer is formed by solution polymerization in an aqueous medium. The aqueous medium may be water, or a mixed water/water-miscible solvent system, such as a water/alcohol solution. The polymerization may be batch, semi-batch, or continuous. The polymers are typically prepared by free radical polymerization but condensation polymererization may also be used to produce a polymer containing the desired moieties. The monomers may be added to the initial charge, added on a delayed basis, or a combination. The polymer is generally formed at a solids level in the range of 15 to 60 percent, and preferably from 25 to 50 percent, and will have a pH in the range of from 1–5, and preferably from 2–4. One reason a pH of above 2 is preferred is for the hazard classification it will be afforded. The polymer may be partially neutralized, generally with sodium, potassium, or ammonium hydroxides. The choice of base, and the partial-salt formed will effect the Tg of the copolymer. The use of calcium or magnesium base for neutralization, produces partial salts having unique solubility characteristics, making them quite useful, depending on the end-use application.

The polymer binder may be random, block, star, or other known polymer architecture. Random polymers are preferred due to the economic advantages, however other architectures could be useful in certain end-uses. Polymers useful as fiberglass binders will have weight average molecular weights in the range of 1,000 to 300,000, and preferably in the range of 2,000 to 15,000. The molecular weight of the copolymer is preferably in the range of 2500 to 10,000, and most preferably from 3000 to 6000.

Admixed with the polymer binder and catalyst is an active hydrogen-containing compound which serves to crosslink the polymer binder. The active hydrogen is preferably in the form of a hydroxyl group, an amine group, or an amide group. In one embodiment of the invention, Polyols and polyamines containing more than one hydroxyl or amine groups may be used. Useful hydroxyl compounds include, but are not limited to, trihydric alcohol; beta-hydroxy alkyl amides; polyols, especially those having molecular weights of less than 10,000; ethanol amines, such as triethanol amine; hydroxy alkyl urea; oxazolidone. Useful amines include triethanol amine, diethylenetriamine, tetraethylenepentamine, and polyethyleneimine. One embodiment of the invention, a polyamine, such as tetraethylenepentamine is used with an acid-containing polymer binder. This polyamine/polymer binder combination may be catalyzed with either the catalysts of the present invention, or may be catalyzed with other catalysts such as phosphorous-containing compounds and fluoroborate compounds.

In one embodiment, the catalyst of the invention is used in combination with a copolymer binder containing both acid-functionality and hydroxyl-, amine-, and/or amide-functionality. In this case, at least one monomer containing active hydrogen functionality is copolymerized with the acid-functional monomer to form a copolymer binder, eliminating the need for a separate source of active hydrogen. Additional external active hydrogen components may optionally be present in the copolymer binder composition, and may serve as a plasticizer as well as a cross-linker. The hydroxyl or amine monomer makes up from 0 to 75 mole percent, and preferably 10 to 20 mole percent of the copolymer. Examples of hydroxyl monomers useful in forming the copolymer of the invention include, but are not limited to hydroxy propyl (meth) acrylate, hydroxy ethyl (meth) acrylate, hydroxy butyl (meth) acrylate and methacrylate esters of poly(ethylene/propylene/butylene) glycol. In addition, one could use the acrylamide or methacrylamide version of these monomers. Also, monomers like vinyl acetate that can be hydrolyzed to vinyl alcohol after polymerization may be used. Preferred monomers are hydroxypropyl acrylate and methacrylate. Examples of amine-functional monomers useful in the present invention include, N, N dialkylaminoalkyl (meth) acrylate, N,N dialkylaminoalkyl (meth) acrylamide, namely dimethylaminopropyl methacrylate, dimethylaminoethyl methacrylate, tert-butylaminoethyl methacrylate and dimethylaminopropyl methacrylamide. In addition monomers like vinyl formamide and vinylacetamide that can be hydrolyzed to vinyl amine after polymerization may also be used. Furthermore, aromatic amine monomers such as vinyl pyridine may also be used. The copolymer could contain a mixture of both hydroxyl and amine functional monomers. It was found that copolymers containing lower levels of these functional monomers were more flexible than copolymers containing higher levels of these functional monomers. While not being bound to any particular theory, it is believed this may be related to the lower Tg copolymers that are formed. Amide-functional monomers could also be used to form the copolymer if a higher cure temperature is used in forming the finished non-woven. The mole ratio of acid-functional monomer to hydroxyl-, or amine-functional monomer is preferably from 100:1 to 1:1, and more preferably from 5:1 to 1.5:1.

The polymer binder may optionally be formulated with one or more adjuvants, such as, for example, coupling agents, dyes, pigments, oils, fillers, thermal stabilizers, emulsifiers, curing agents, wetting agents, biocides, plasticizers, anti-foaming agents, waxes, flame-retarding agents, and lubricants. The adjuvants are generally added at levels of less than 20 percent, based on the weight of the copolymer binder.

The copolymer binder composition is useful for bonding fibrous substrates to form a formaldehyde-free non-woven material. The copolymer binder of the invention is especially useful as a binder for heat-resistant non-wovens, such as, for example, aramid fibers, ceramic fibers, metal fibers, polyrayon fibers, polyester fibers, carbon fibers, polyimide fibers, and mineral fibers such as glass fibers. The binder is also useful in other formaldehyde-free applications for binding fibrous substances such as wood, wood chips, wood particles and wood veneers, to form plywood, particleboard, wood laminates, and similar composites.

The copolymer binder composition is generally applied to a fiber glass mat as it is being formed by means of a suitable spray applicator, to aid in distributing the binder composition evenly throughout the formed fiberglass mat. Typical solids of the aqueous solutions are about 5 to 12 percent. The binder composition may also be applied by other means known in the art, including, but not limited to, airless spray, air spray, padding, saturating, and roll coating. The residual heat from the fibers causes water to be volatilized from the binder, and the high-solids binder-coated fiberglass mat is allowed to expand vertically due to the resiliency of the glass fibers. The fiberglass mat is then heated to cure the binder. Typically the curing oven operates at a temperature of from 130° C. to 325° C. The fiberglass mat is typically cured from 5 seconds to 15 minutes, and preferably from 30 seconds to 3 minutes. The cure temperature will depend on both the temperature and the level of catalyst used. The fiberglass mat may then be compressed for shipping. An important property of the fiberglass mat is that it will return to its full vertical height once the compression is removed.

Properties of the finished non-woven (fiberglass) include the clear appearance of the film. The clear film may be dyed to provide any desired color. Another advantage of the copolymer binder composition is that it produces a flexible film. This is important in fiberglass insulation that needs to bounce back after one unwraps the roll and uses it in walls/ceilings. It was found that the use of the catalyst systems of the present invention could produce films that were not just flexible, meaning they could bend without breaking, but were also elastic in that they returned to the original shape after deformation.

The fiberglass, or other non-woven treated with the copolymer binder is useful as insulation for heat or sound in the form of rolls or batts; as a reinforcing mat for roofing and flooring products, ceiling tiles, flooring tiles, as a microglass-based substrate for printed circuit boards and battery separators; for filter stock and tape stock and for reinforcements in both non-cementatious and cementations masonry coatings.

The following examples are presented to further illustrate and explain the present invention and should not be taken as limiting in any regard.

EXAMPLE 1

Control 75.2 grams of a polyacrylic acid (ALCOSPERSE 602A from Alco Chemical) and 12.4 grams of triethanolamine (TEA) and 12.4 grams of water was mixed to form a homogenous solution.

EXAMPLE 2

Comparative 75.2 grams of a polyacrylic acid (Alcosperse 602A from Alco Chemical) and 12.4 grams of TEA and 5.0 grams of sodium hypophosphite (SHP) and 7.4 grams of water was mixed to form a homogenous solution.

EXAMPLES 3–17

The ingredients in the Table below were mixed to form a homogenous solutions. The solutions were made up to 100 percent by adding water.

TABLE 1

| Sample | Wt % poly(acrylic acid) Alcosperse 602A from Alco Chemical | Wt % TEA | Catalyst | Wt % catalyst |
|---|---|---|---|---|
| Example 3 | 75.2 | 12.4 | $MgCl_2$, $6H_2O$ | 5 |
| Example 4 | 75.2 | 12.4 | $MgCl_2$, $6H_2O$ | 2.5 |
| Example 5 | 75.2 | 12.4 | 70% Tert-butylhydroperoxide | 5 |
| Example 6 | 75.2 | 12.4 | 35% $H_2O_2$ | 5 |
| Example 7 | 75.2 | 12.4 | Sodium salicylate | 5 |
| Example 8 | 75.2 | 12.4 | Magnesium zirconate | 0.5 |
| Example 9 | 75.2 | 12.4 | Magnesium titanate | 0.5 |
| Example 10 | 75.2 | 12.4 | Tyzor 217 zirconium lactate complex (from Dupont) | 5 |
| Example 11 | 75.2 | 12.4 | $Mg(OH)_2$ | 1 |
| Example 12 | 75.2 | 12.4 | $Mg(OH)_2$ | 2.5 |
| Example 13 | 75.2 | 12.4 | $Mg(OH)_2$/citric acid | 2.5/2.5 |
| Example 14 | 75.2 | 12.4 | MgSO4 | 2.5 |
| Example 15 | 75.2 | 12.4 | $Mg(OH)_2$/acetic acid | 2.5, 2.5 |
| Example 16 | 75.2 | 12.4 | $Mg(OH)_2$/tartaric | 2.5/2.5 |
| Example 17 | 75.2 | 12.4 | ZnSO4 | 2.5 |

EXAMPLE 18

The testing protocol was as follows: 20 grams of each of solution was poured into PMP Petri dishes and placed overnight in a forced air oven set at 60° C. The film was then cured by being placed for 10 minutes in a forced air oven set at 150° C. After cooling, the resulting films were evaluated in terms of physical appearance, flexibility, and tensile strength.

TABLE 2

| SAMPLE # | COMPOSITION | APPEARANCE | FLEXIBILITY | TENSILE |
|---|---|---|---|---|
| Example 1, control | PAA/TEA | "Swiss cheese", yellow-brown color | Low flex, breaks easily | Breaks readily |
| Example 2, comparative | PAA/TEA/ 10% SHP | "Swiss cheese", slight yellowing | Slight flexibility, breaks easily | Stretches, tensile slightly stronger than Example 3 |
| Example 3 | PAA/TEA/ 5% $MgCl_2.6H_2O$ | Very irregular surface from bubbling, yellow-brown color | Very flexible but does break | Breaks readily |
| Example 4 | PAA/TEA/ 10% $MgCl_2.6H_2O$ | Very irregular surface from bubbling, yellow-brown color | Very flexible but does break | Breaks readily |
| Example 5 | PAA/TEA/ 10% TBHP | "Swiss cheese" appearance, very slight yellowing | Flexible but does break | Difficult to break, very little elasticity |
| Example 6 | PAA/TEA/ 10% $H_2O_2$ | Clear, "Swiss cheese" appearance | Breaks easily | Very strong tensile |
| Example 7 | PAA/TEA/ 10% sodium salicylate | "Swiss cheese" appearance, slight yellowing | Breaks easily | Not as strong as control |
| Example 8 | PAA/TEA/1% magnesium zirconate | "Swiss cheese" from bubbling | low, breaks easily | similar to Example 2 |
| Example 9 | PAA/TEA/1% magnesium titanate | "Swiss cheese" from bubbling | low, breaks easily | slightly stronger than Example 1, less than Example 2 |
| Example 10 | PAA/TEA/ 10% Tyzor 217 zirconium lactate complex | wrinkled, very irregular | more than Example 1, less than Example 2 | similar to Example 1 |
| Example 11 | PAA/TEA + 2% $Mg(OH_2)$ | wrinkled, very irregular | more brittle than Example 2 | similar to Example 2 |
| Example 12 | PAA/TEA + 5% $Mg(OH_2)$ | wrinkled, very irregular | more brittle than Example 2 | similar to Example 2 |
| Example 13 | PAA/TEA + 5% $Mg(OH_2)$ + 5% citric acid | wrinkled, very irregular | more brittle than Example 2 | similar to Example 2 |
| Example 14 | PAA/TEA + 5% $MgSO_4$ | wrinkled, irregular surface | slightly more flexible than Example 1 | similar to Example 2 |
| Example 15 | PAA/TEA + 5% $Mg(OH_2)$ + 5% acetic | wrinkled, very irregular | more brittle than Example 2 | similar to Example 2 |
| Example 16 | PAA/TEA + 5% $Mg(OH_2)$ + 5% tartaric acid | wrinkled, very irregular | more brittle than Example 2 | similar to Example 2 |
| Example 17 | PAA/TEA + 5% $ZnSO_4$ | wrinkled, very irregular | Similar to Example 2 | similar to Example 2 |

EXAMPLE 19

A blend of 75.2 g of polyacrylic acid (ALCOSPERSE 602A), 12.4 g of polyamine (tetraethylenepentamine), and 5 percent SHP were admixed to form a homogeneous solution. Films of the solution were made an tested as in Example 18. The results are shown in Table 3

TABLE 3

| SAMPLE # | COMPOSITION | APPEARANCE | FLEXIBILITY | TENSILE |
|---|---|---|---|---|
| Example 19 | PAA/tetraethylene-pentamine/5 % SHP | Very irregular surface from bubbling, | Slight flexibility, breaks easily | Stretches, tensile slightly stronger than Example 3 |

The data shows that a polyamine like tetraethylenepentamine can be used instead of a polyol and give similar benefits.

EXAMPLE 20

The polymers of Example 2 and 3 as well as a phenol formaldehyde resin were applied to a veneer with grain oriented at a 90 degree angle on successive layers. The plywood composite formed was cured by application of heat. The strength and dimensional stability of the plywood composites formed by using the binder of example 2 and 3 would be similar to that using the conventional phenol-formaldehyde resin.

What is claimed is:

1. A non-woven binder composition comprising:

a water soluble polymeric binder synthesized from one or more acid monomers, the one or more acid monomers selected from the group consisting of one or more carboxylic acid monomers, one or more sulfonic acid monomers, one or more phosphonic acid monomers or mixtures thereof, wherein the one or more acid monomers comprise from 50 to 95 mole percent of the polymeric binder, an active hydrogen cross-linker for crosslinking with the polymeric binder, and from 1 to 25 percent by weight of a catalyst based on the weight of the binder, wherein said catalyst is selected from the group consisting of a Lewis acid, an organic acid salt, a free radical generator, or a mixture thereof, and wherein the binder composition is an aqueous composition.

2. The binder composition of claim 1 comprising from 1 to 10 percent by weight of the catalyst.

3. The binder composition of claim 1 wherein said catalyst is a Lewis acid.

4. The binder composition of claim 3 wherein said Lewis acid is selected from the group consisting of $Al_2(SO_4)_3.H_2O$, $MgCl_2.6H_2O$, $AlK(SO_4)_2.10H_2O$, $MgSO_4$, $ZnSO_4$ and combinations thereof.

5. The binder composition of claim 1, wherein said acid monomer comprises acrylic acid, methacrylic acid, or a mixture thereof.

6. The binder of claim 1 wherein said polymeric binder and said active hydrogen cross-linker comprise a single copolymer comprising at least one acid monomer unit and at least one hydroxyl-, amine-, or amide-functional monomer unit.

7. The binder composition of claim 5, wherein said copolymer contains acid monomer to hydroxyl-, amine-, or amide-functional monomer in a ratio of from 100:1 to 1:1.

8. The binder composition of claim 1 further comprising from 0 to 20 weight percent of one or more adjuvants selected from the group consisting of coupling agents, dyes, pigments, oils, fillers, thermal stabilizers, emulsifiers, curing agents, wetting agents, biocides, plasticizers, anti-foaming agents, waxes, flame-retarding agents, and lubricants.

9. The binder of claim 1 wherein said non-woven is fiberglass.

10. The binder composition of claim 1, said active hydrogen cross-linker further comprising at least one hydroxyl-, amine-, or amide-functional monomer unit.

11. The binder composition of claim 10 wherein the mole ratio of acid-functional monomer to hydroxyl-, amine-, or amide-functional monomer is from 100:1 to 1:1.

12. The binder composition of claim 1, said active hydrogen cross-linker further comprising a polyol having at least one hydroxyl-functional group.

* * * * *

UNITED STATES PATENT AND TRADEMARK OFFICE

CERTIFICATE OF CORRECTION

PATENT NO. : 7,141,626 B2
APPLICATION NO. : 10/283430
DATED : November 28, 2006
INVENTOR(S) : Klein A. Rodrigues et al.

It is certified that error appears in the above-identified patent and that said Letters Patent is hereby corrected as shown below:

On title page (75) please delete the name of the fourth inventor "Bick Hicks" and replace it with the correct spelling of the inventor's given name -

--Rick Hicks--

Signed and Sealed this

Twentieth Day of February, 2007

JON W. DUDAS
*Director of the United States Patent and Trademark Office*